US006538580B2

(12) United States Patent
Boström et al.

(10) Patent No.: US 6,538,580 B2
(45) **Date of Patent: *Mar. 25, 2003**

(54) METHOD AND DEVICE FOR REGISTERING THE OUTER CHARACTERISTICS OF A VEHICLE IN A ROAD TOLL UNIT

(75) Inventors: Göran Boström, Huskvarna (SE); Anita Liew, Tenhult (SE); Johan Frilund, Jönköping (SE)

(73) Assignee: Combitech Traffic Systems AB, Jönköping (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/269,712

(22) PCT Filed: Oct. 3, 1997

(86) PCT No.: PCT/SE97/01588

§ 371 (c)(1),
(2), (4) Date: Jun. 8, 1999

(87) PCT Pub. No.: WO98/14925

PCT Pub. Date: Apr. 9, 1998

(65) Prior Publication Data

US 2002/0105440 A1 Aug. 8, 2002

(30) Foreign Application Priority Data

Oct. 3, 1996 (SE) ..... 9603625

(51) Int. Cl.[7] ..... G08G 1/01

(52) U.S. Cl. ..... 340/933; 340/928; 340/937; 235/384

(58) Field of Search ..... 340/933, 928, 340/937, 940, 941, 942, 943, 939; 235/384, 380, 379

(56) References Cited

U.S. PATENT DOCUMENTS

| | | | | | |
|---|---|---|---|---|---|
| 4,075,632 | A | | 2/1978 | Baldwin et al. | |
| 4,242,661 | A | | 12/1980 | Henoch et al. | |
| 5,101,200 | A | * | 3/1992 | Swett | 340/937 |
| 5,602,375 | A | * | 2/1997 | Sunabara et al. | 235/384 |
| 5,757,286 | A | * | 5/1998 | Jonsson et al. | 340/937 |
| 5,825,007 | A | * | 10/1998 | Jesadanont | 235/384 |
| 5,859,415 | A | * | 1/1999 | Blomqvist et al. | 235/384 |
| 5,969,641 | A | * | 10/1999 | Nakamura et al. | 235/384 |
| 6,109,525 | A | * | 8/2000 | Blomqvist et al. | 235/384 |
| 6,195,019 | B1 | * | 2/2001 | Nagura | 340/928 |

FOREIGN PATENT DOCUMENTS

| | | |
|---|---|---|
| WO | WO 9428377 | 12/1994 |
| WO | WO 9428516 | 12/1994 |

* cited by examiner

*Primary Examiner*—Nina Tong
(74) *Attorney, Agent, or Firm*—Connolly Bove Lodge & Hutz LLP

(57) ABSTRACT

A method and a device for image registration of the external characteristics and the number plate of a vehicle in a road toll unit for checking the payment status relating to a toll fee, which is intended to be collected by means of remote communication. During the checking and payment operation, the vehicle is followed by successive video recordings. In these recordings, a marker is connected to the vehicle. The same marker is connected to the image of the number plate and to an image of the physical shape of the vehicle. In the event of incorrect payment, a search may be performed based upon both the image of the number plate and the associated image of the physical shape of the vehicle, which are connected together by means of the successive following of the position of the vehicle. The class of the vehicle may thus be determined, in accordance with a classification scheme based on the physical properties of the vehicle, from the image of the external characteristics of the vehicle for determining the toll fee.

16 Claims, 2 Drawing Sheets

METHOD AND DEVICE FOR REGISTERING THE OUTER CHARACTERISTICS OF A VEHICLE IN A ROAD TOLL UNIT

TECHNICAL FIELD

The present invention relates to a method and a device for registering the outer characteristics of a vehicle in a road toll unit, wherein registration of the number plate, or other identification characteristic, of the vehicle may be carried out.

STATE OF THE ART

At automatic road toll units for a free traffic flow, it is assumed that the majority of vehicles passing are provided with a receiver-transmitter unit for radio waves such as a transponder. The road toll unit comprises an arrangement, by which communication over the radio waves may take place with passing vehicles. This arrangement comprises a transmitter and a receiver for the radio waves, by means of which equipment payment and debiting operations may be carried out for the passing vehicles, which are provided with the above-mentioned transponder. For this technology, reference is made, for example, to U.S. Pat. No. 4,075,632 and U.S. Pat. No. 4,242,661.

However, it may occur that the toll unit is passed by vehicles which do not have the correct payment equipment. For identification of such vehicles, if they attempt to pass the toll unit without making payment in any way, the toll unit is provided with camera devices for image registration of the number plates of such vehicles to enable tracing and subsequent charging.

In case of a large traffic volume in free formation, the respective vehicle will be able to move a certain distance between the time where a detection is carried out whether the vehicle is equipped to carry out a correct payment operation or not, and the time of recording the number plate.

During this movement of the vehicle, a division must be maintained between vehicles which are to be traced and subsequently charged, and vehicles for which payment has been secured. This requires that the toll arrangement is provided with equipment for registering the successive forward movement of the vehicle, such that it is ensured that an image is secured for the correct vehicle, that is, the vehicle for which an unsatisfactory payment status has been established in the road toll unit. This positioning check-up shall be capable of being carried out while several vehicles are moving in a free flow with possible lane-changing during the passage through the road toll unit. The check of the payment status shall be capable of being carried out at full speed of the vehicles, which leaves very little time for this operation.

From WO 94/28377 (Jonsson, Isaksson), an arrangement for registering the movement of the vehicles in the road toll unit is known. For this purpose, video cameras placed over the roadway are used, the position and successive movement of the respective vehicle being registered on the image plane of these cameras. In an image processing computer, a contour of the vehicle is connected to its identity in an image processing operation, and via the movement of this contour in the image plane in the camera, the movement of the vehicle can be successively registered. In the image processing operation, the position for the recording area is programmed to the camera which was used for imaging the number plate. When the vehicle is situated at this imaging point, exposure of the number plate may be performed by activating the imaging camera. The vehicle, the movement of which is being followed, has been identified, after entering the road toll unit, with regard to its payment status, such that for those vehicles which have an unsatisfactory payment status, an image may be presented.

DESCRIPTION OF THE INVENTION

The magnitude of the fee, with which vehicles passing the road toll unit is to be debited, is generally dependent on the type and size of the vehicle. For example, a single private car is charged a lower fee than a private car to which a trailer has been coupled, lorries are charged a still higher fee and, in addition, a surcharge if they have a trailer coupled to them, etc. The number of wheel axles may also be determining for the fee. In the normal case, it may be expected that the factors determining the size of the fee are clear from the radio message from the vehicle. However, experience shows that correct information is not always given. In such vehicles for which, because of an incorrectly effected payment operation, an image is to be taken, it may occur that the correct vehicle type cannot be obtained through the number plate, or that a check-up via the number plate becomes too complicated.

To ensure that a correct fee can always be debited, there is therefore a need to be able to register such external vehicle characteristics, as are of importance for the calculation of the fee, during the passage without disturbing the free flow. In this context, it is desirable to have a possibility, on the one hand, of determining the type of vehicle combinations which are being imaged because of an unsatisfactory payment status, and, on the other hand, of checking that the information which is obtained via radio communication from the vehicle equipment is correct.

The invention is based on the realization that the above-mentioned arrangement comprising video recording of the movement of the vehicle may be extended to provide an indication of the type of the vehicle and the composition of passing vehicles. During the payment operation, this indication may then be used to establish these data for the vehicles, the number plates or corresponding characteristics of which have been imaged for tracing and for checking whether these correspond to the information which has been communicated from the vehicle equipment.

In one embodiment of the invention, the indication of the type of vehicle, which may be obtained through the video recording, is supplemented by detection of the number of vehicle axles by means of sensors in the roadway. The reason for this is that the number of wheel axles is an often used means of determining the toll fee. If the video image is taken from above and down towards the roadway, the number of wheel axles may be difficult to read only from the image.

One important condition of the invention is that a system for following the position is used, which provides an unassailable connection of the image recording of the external shape of the vehicle and, where applicable, the registration of the number of vehicle axles with the registration of the identity of the vehicle, such as by means of an image of the number plate thereof. In this connection, the prior art disclosed in the above-mentioned WO94/28377 is preferably applied.

BRIEF DESCRIPTION OF THE DRAWINGS

The accompanying drawings illustrate a preferred embodiment of the invention, wherein.

PREFERRED EMBODIMENT

Figure 1:
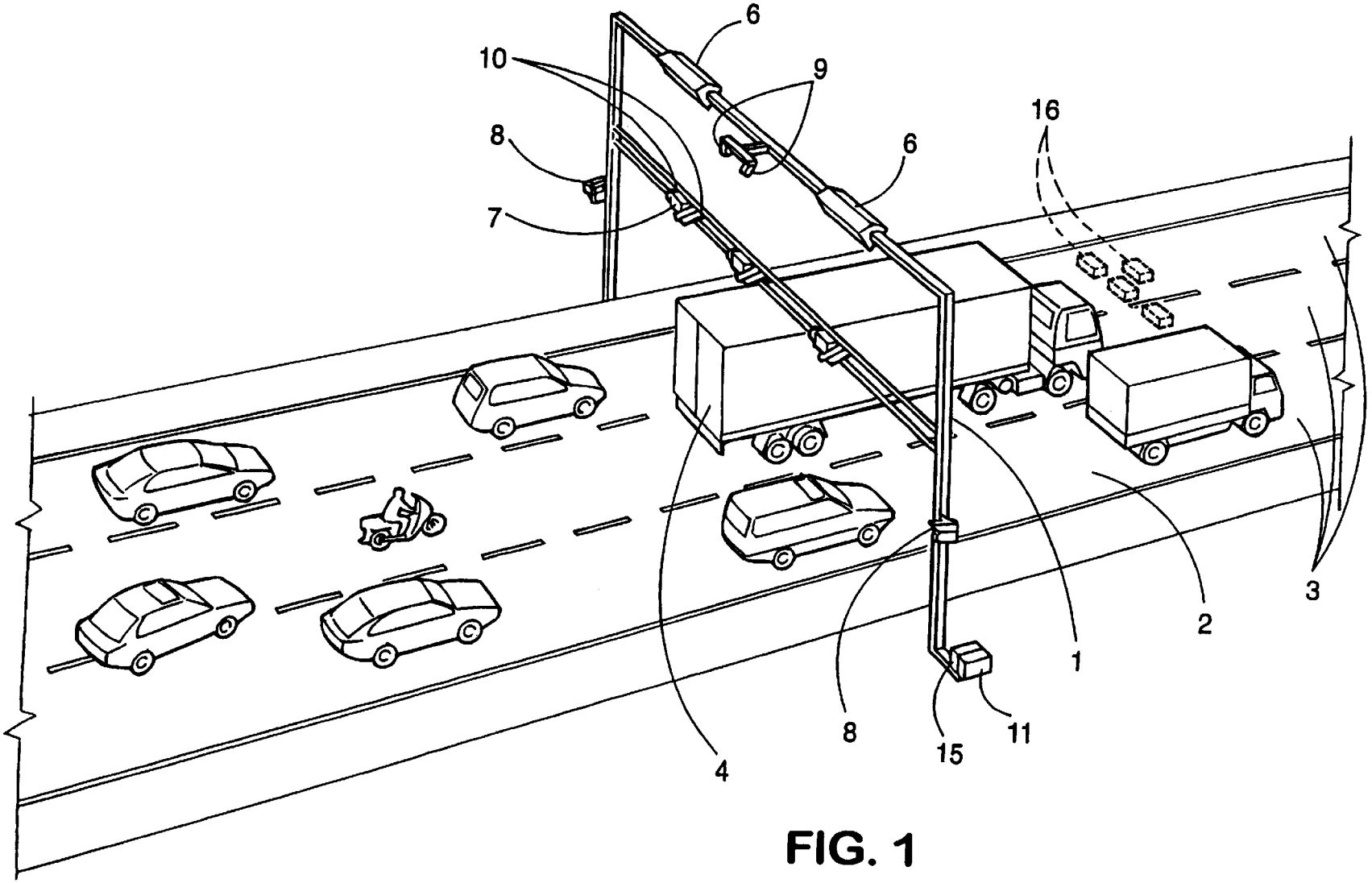
FIG. 1 shows, in perspective view, a road toll arrangement with passing vehicles.

According to FIG. 1, an automatic road toll unit according to the invention is provided with a stand 1 which extends over a road 2, which has three lanes 3 in which different kinds of vehicles may be driven through the portal-like stand 1. The designation 4 refers to a commercial vehicle comprising a traction vehicle and a trailer with a total of four wheel axles. The vehicles are not restricted to keep to the lanes under the stand but are allowed to carry out file-changing and overtaking. Thus, it is a free-flow system designed to disturb the traffic flow as little as possible.

Two light fittings 6 and a number of transmitter and receiver units 7 (three being shown here) for microwaves, including aerials therefor, are attached to the stand. These units are adapted for communication with units in the vehicle. These units will be described later on. The microwaves also allow the position of such vehicle units, to which the fixed equipment 7 is transmitting, to be determined during the communication cycle.

At each side of the stand there is a video camera 8, directed towards the approaching traffic flow, to register vehicles which are impermissibly driven on the verge. In addition, two video cameras 9, directed towards the road, are shown at the very top in the centre of the stand. More such cameras may alternatively be arranged. Further, three pairs of video cameras 10 are directed towards and away from the traffic flow. These pairs of cameras are shown as placed approximately in the centre of the respective three lanes 3. To register and process the camera recordings, an image processing unit 15 is arranged.

As mentioned by way of introduction, it happens that the toll fee is partly based on the number of wheel axles of the vehicle in question. As also mentioned, it may be difficult or impossible to determine this number by means of images recorded from the cameras 9 from above the vehicle. In case of large commercial vehicles, and it is mostly such vehicles which are equipped with more than two wheel axles (see 4 in FIG. 1), the wheel housings are often concealed by the superstructure and are not reproduced in a view from above. For the number of wheel axles to be detected, according to the suggested embodiment, a number of sensors 16 are provided, embedded into the roadway, which register when a vehicle wheel passes over them. The sensors may be pressure sensors or inductive sensors, which react to the mass of metal in the passing wheel. However, such technique is well known and need not be described in detail here.

All of this equipment is connected to a central installation 11 for control thereof and for processing of recorded data. This installation is then, in turn, connected to a central network for further communication.

Figure 2:
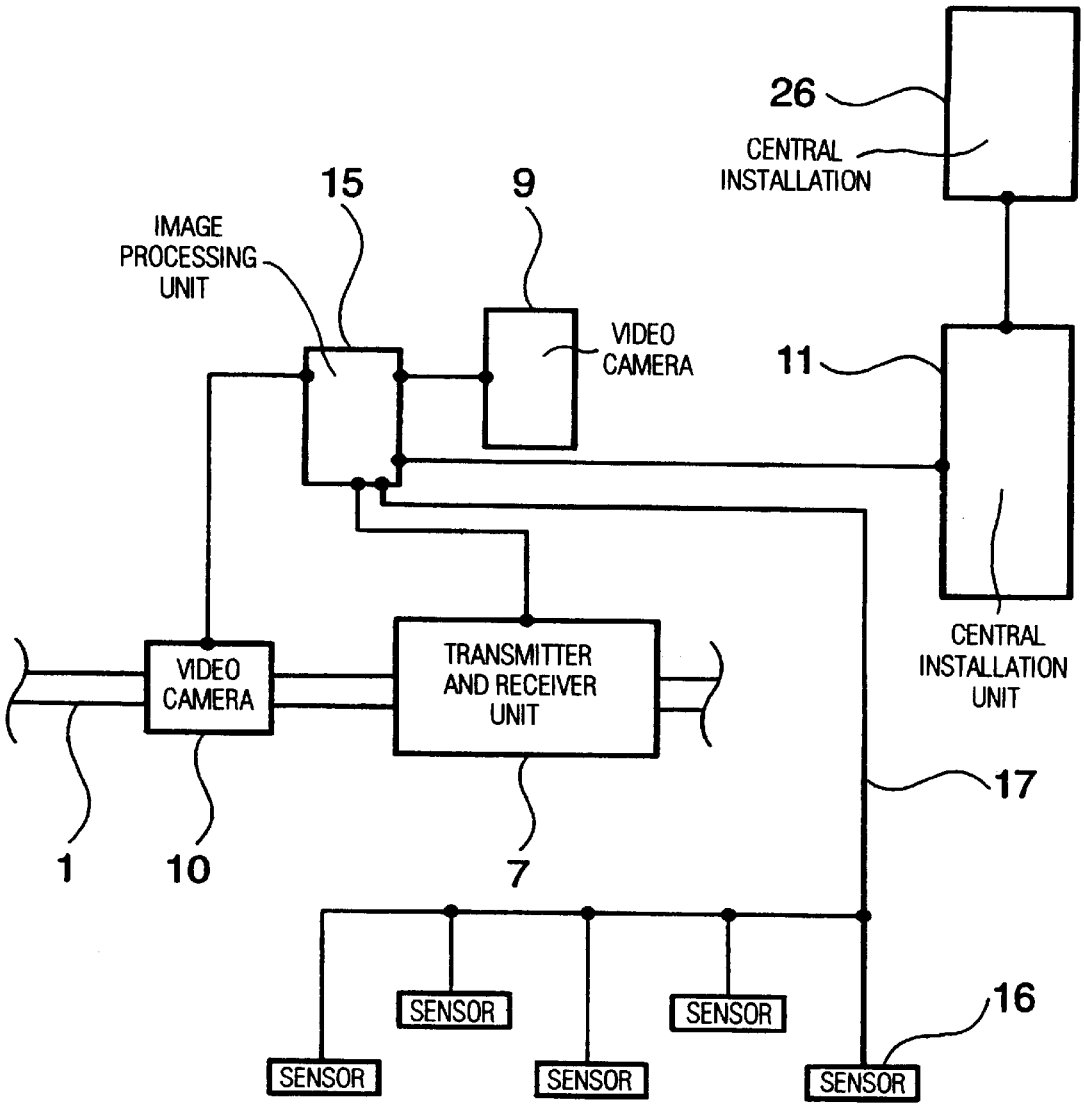
FIG. 2 schematically shows, in a block diagram, the functional units in the invention.
Figure 2:
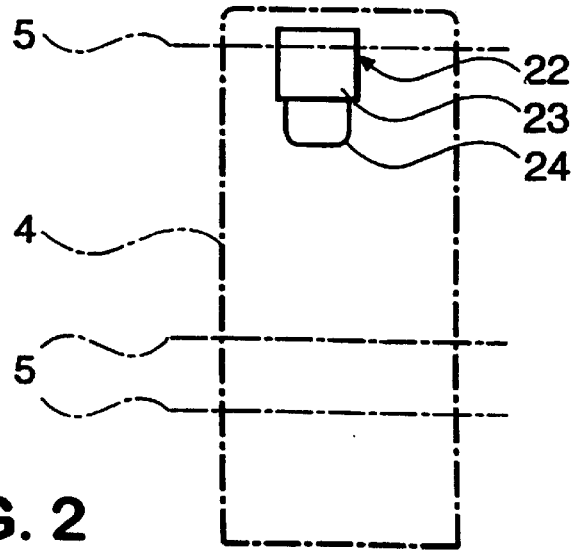

The main functions and functional units of the arrangement are schematically shown in the block diagram in FIG. 2. 22 designates the equipment with which, as is assumed, the majority of the vehicles are provided. The four-axle commercial vehicle designated 4 is indicated in FIG. 2 by dash-dotted lines and its wheel axles are designated 5.

Such equipment 22 may be a transponder unit 23, which is adapted to capture microwaves and transform them into a reply signal containing information for identification of the vehicle, and, in addition, a smart card for conveying data via the transponder, which data, besides identification data, may consist of data relating to payment conditions (whether debiting is to be made or whether prepayment via a charge card 24, a smart card, has been made).

The other elements in the block diagram relate to the stationary equipment. On the stand are mounted the transmitter and receiver equipment 7 for microwaves and the two cameras 9 as well as the video cameras 10 (one being shown) and the image processing unit 15, which are all identified by these numbers also in the block diagram.

Furthermore, there are shown the sensors 16 in the roadway and a cable 17 by which they are connected to the image processing unit 15 which, in turn, is connected to the central unit 11.

The other elements belong to the mentioned equipment with which the equipment on the stand and in the roadway communicates. This equipment comprises said unit 11 for control of the transmitter-receiver equipment 7 and which controls the debiting for vehicles which are provided with the equipment 22 as well as the unit 15 for registering and processing the video images.

The above-mentioned equipment for checking vehicles, which are not provided with any unit 22–24 and for which there is a need of identification in some other way as well as investigation for subsequent charging, comprises the cameras 9 for identifying and following vehicles, in particular those which lack correct equipment 22, and the video cameras 10 (only one being shown) for imaging the number plate of the vehicles in order that these may be traced. The video cameras 9 and 10 are connected to the unit 15 for control and analysis and for collection of registered video images and possible compression and storage thereof. These images may be communicated to a central installation 26 for subsequent processing in connection with tracing and subsequent charging of vehicles which have passed without paying.

When the road toll unit is provided with the sensors 16 for sensing passing wheels, also these sensors are to be connected to the control equipment. By sensing the passage of the wheels, the axles of a passing vehicle may be registered. However, this registration must be supplied to the image recording. For this reason, the sensor impulses are supplied to the image processing unit 15. The position of the sensors is programmed into this unit, and by means of image processing of the video images recorded by means of the cameras 9, the successive movement of each vehicle is all the time established, and it is thus possible to determine which vehicle with the associated marker that the sensor impulses relate to.

The image processing unit is preferably adapted to supply, to the vehicle recording, markings for the wheel axles, as indicated at the vehicle 4 in FIG. 2 by means of the markings 5.

Thus, if an image from above of a vehicle is stored for checking the class of the vehicle and possibly for argumentation in case of violation, this image will comprise the actual imaging of the vehicle, the marker for the vehicle, which connects it with the imaging of the registration characteristic, provided with the corresponding marker, and, in addition, line markings of the vehicle axles.

When carrying out the above-mentioned payment operations, the result communicated to the central unit is either, and in the normal case, a report of debiting of a fixed fee connected to certain registering data such as the identity of the toll unit and the time, or, if the passage has taken place without a correct payment operation, identification data for the vehicle based on the image of the number plate or, alternatively, recording of some other identification characteristic. At present, the only useful identification sign is the number plate, which has to be registered visually. This visual registration may, in turn, be transferred to the work unit which is to carry out the tracing and the subsequent collection of payment, in the case of "evading" vehicles, with the aid of the recorded video image. It is possible, however, to process the video image such that the registration signs are read and transferred in the form of characters. It is possible that the development leads to the use of other means of registration than visually readable plates, and in such case the registration equipment for recording the vehicle identity shall be adapted for the assumed method of communication. For example, registered vehicles may be equipped with fixedly mounted transponders for reading by means of radio waves. The reference to the image of the number plate used here is to be considered to refer also to other types of identification characteristics for the vehicles.

To achieve the object of the invention, to provide a free flow of traffic through the toll unit also when a registration of the vehicle class is carried out, the method is extended to utilize the video recording by means of the cameras 9 which are arranged for following the vehicles between the passage of the imaging point and until the radio communication for the payment operation is carried out, for registering the characteristics which determine the vehicle class in the fee system established.

In the normal case, when the payment operation during passage of the vehicle is carried out by means of deduction from a prepaid card or debiting to an account, the sequence of operations of the method are as follows:

The vehicle approaches, the microwave transmitter in the toll unit thus being activated.

A command is sent, the transponder of the vehicle responds, the microwave transmitter 7 registers the entry position of the vehicle and checks the payment status. As mentioned, the microwave system may also be adapted to follow the movement of the transponder and hence of the vehicle.

The position of the vehicle is registered in the video follow-process starting from an entry position and is connected to a marker in the successive video recording, and preferably also to an indication of the time of entry at the toll unit.

The processing of the images of the cameras 9 is initiated and completed while following the movement of the vehicle, with said marker all the time being connected to the vehicle. This follow-process is maintained at least until the vehicle has reached an imaging position.

In said imaging position, which in the direction of travel lies after the entry position, the number plate, or other identification characteristic, of the vehicle is recorded by imaging (cameras 10) the number plate of the vehicle, or some other kind of registration. The recording is connected to the video follow-process by utilizing said marker.

When, by means of the radio communication cycle, a correct payment status has been established, the video recordings are erased from both cameras 9 and 10 relating to the vehicle in question, which has been identified by its connection to said marker. This requires that also the radio communication is correlated to the video recordings.

To make it possible to determine the vehicle class and hence collect the proper fee, the message from the vehicle equipment also contains an indication of the class. If, however, it is desirable to utilize the possibility, according to the invention, of obtaining a check-up of this, directly based on the physical shape of the vehicle or vehicle combination, this can be done in the following way:

The processing of the images from the cameras 9 is not directed only to a successive position determination for following the vehicle but also to an analysis of the visual characteristics of the vehicle. Thus, the image processing may relatively easily be directed to determine whether the passing unit is a vehicle combination composed of several units such as a traction vehicle and a trailer. When several units are registered, it may also be determined whether the distance between these varies because of the fact that it is actually a question of two vehicles following each other closely, however, in practice, not at such a precise distance from each other as is the case for vehicles composed of several units.

Other characteristics, especially the number of wheel axles, may, however, be impossible to detect by image processing. As described earlier, the road toll unit may be provided with the sensors 16 in the roadway to register the number of wheel axles. How this registration is supplied to the image by mark scanning in the follow-image of the movement of the vehicle has also been described. In this way, it is thus possible to obtain complete documentation for determining the vehicle class as well as documentation for safe identification of the vehicle through its external characteristics, if this should be required for submission of evidence in case of violation.

The data regarding the classification, which emerge through the described analysis, are compared with those data which are recorded by the radio receiver of the toll unit. If these data do not correspond, the vehicle shall be registered for such corrected debiting as is justified by the non-correspondence. Alternatively, the vehicle is traced via an image of the number plate, such that correction can be made and any penalty be collected. Reference is made to the following description of such a procedure.

If the radio-wave communication or the absence thereof indicates that the vehicle does not have the correct payment status, the sequence of operations will be as follows:

After continued and completed radio communication, or, if there is no functioning vehicle equipment, attempts at achieving such communication, for checking the payment status, the result is linked to the identification through said marker, which has been assigned to the respective vehicle when the video follow-process was started at the entry position.

When it has been established, through the communication equipment, that it has not been possible to carry out the correct payment operation, both the image of the number plate and at least one image of the vehicle/vehicle combination, recorded by means of the cameras 9, are stored, the two images being connected to each other by said marker and preferably also by a common indication of time. Since also the result of the radio communication is connected to the same marker, there exists for the vehicle, to which this marker has been assigned, a linking identification of registration data and the result of the radio communication or, if there is no functioning vehicle equipment, an indication of this.

In the proposed embodiment, the mentioned image recording cameras 9 are supplied with markings for the wheel axles of the vehicle. These markings are arranged by matching the impulses from the sensors 16 with the instantaneous position at the relevant impulse for the vehicle, which is registered in the follow-process by means of the image processing. There may be additional data registered during the radio communication, which indicate the kind of deficiency in the payment operation.

The recorded data, the vehicle identity by means of the image of the vehicle number plate or other identification characteristic, as well as the image taken by means of the cameras 9 of the physical shape of the vehicle and, where applicable, data from the radio communication are communicated to the intended work unit for tracing the vehicle. For this purpose, the vehicle identity is used for the tracing and the image of the physical shape of the vehicle, where appropriate with said axle markers added, for determining the class of fee thereof.

The vehicle identity may be determined by manual reading of the image and it is also possible to analyze the image of the physical shape of the vehicle manually. As mentioned, the image of the number plate may alternatively be analyzed by image processing and also the vehicle class be determined by such processing. Irrespective of whether the image is analyzed manually or by image processing, the image may be stored as evidence in case of violation. The situation might arise that if, as documentation for the debiting, only the recording of the number plate is presented, the party concerned might claim that this is no actual evidence. However, a considerably stronger, and Presumably unassailable, evidence is probably the connection by means of said marker of the image of the number plate with the top view of the vehicle, where appropriate provided with said wheel axle markings.

It should be mentioned that recording of the vehicle identity, as by means of the cameras 10, has been assumed here to take place early during passage of the toll unit. This implies that these images must be saved until the radio communication has been carried out. The checking process may be carried out after passage and, if this is done, all the images/registrations are to be stored until the check-up has been performed. The image is thus erased in case of a correct payment operation and stored for subsequent processing in case of an incorrect payment operation.

As assumed in FIG. 1, an image may then be taken in such a way that both the front and rear number plates of the vehicle are imaged. It is possible, however, to make the image at a later stage during the passage through the toll unit, when the radio communication and the establishment of the payment status have been executed. In that case, the procedure may be such that an image is made only if an incorrect payment status has been determined. This implies that all such images will be saved.

How the device for carrying out the method is designed will have been clear for the most part from the preceding description. An essential part in this context is the image processing equipment, which is designated 25 in FIG. 2. This is to be arranged, in one or more units, also comprising image and data storage media, for carrying out the following functions:

Storage of identification data such as images by means of the cameras 10 and any image analysis of the registration characters for generating character data for further communication.

Receipt of positioning data recorded by means of the radio communication equipment 7 to be linked to the images from the cameras 9 relating to the successive position determination for the vehicles from the entry position and at least until registration of the vehicle has taken place in the registration position (by the cameras 10).

Generation of markers and preferably also indications of time for connection to the associated recordings of identification data for the vehicles and in the successive following of the position as well as connection of these data to the respective image.

Storage of at least one image indicating the physical shape of the relevant vehicle, recorded by means of the cameras 9 and, where appropriate, supplemented by markings for the wheel axles.

Joint processing of images and data from the radio communication equipment while linking them to a certain marker for determining the result of the payment operation, approved or not approved, and activation of either erasure of the images in the cameras 10 and the image of the physical shape of the vehicle in the cameras 10, or, alternatively, saving them for further communication of said data to the appropriate work unit.

If, in addition thereto, the device is to be used for checking the correspondence between physical data and class data communicated from the vehicle equipment by means of radio communication, also the following function should be provided:

Analysis of image data relating to the physical shape of the vehicle and generation of class data, which are comparable with assumed class data programmed into the vehicle equipment, as well as transfer to unit 11, such that such comparison may take place.

Receipt of the message from the unit 11 on the result of the comparison, whereby, if the respective data correspond and an otherwise correct payment operation has taken place, erasure of recorded images takes place whereas, if the data do not correspond, the respective recordings from the cameras 9 and 10 are saved for subsequent processing comprising charging a tool fee and any penalty as well as presentation of the picture evidence relating to the offense.

In the embodiment, it has been assumed that the cameras 9, which are used for successively determining the position of the vehicles, are also used for recording the external shape of the vehicle. This is an advantageous embodiment in that the work of these cameras generates the above-mentioned marker, which is linked to the vehicle and which also occurs linked to the recording of the registration characteristics of the vehicle, such that the desired securing of evidence is established. However, it is within the scope of the invention that one or more special cameras are arranged for imaging the physical shape of the vehicle. These must then operate controlled by the position follow-process and the images must be provided with the same marker which is generated through the work of the cameras 9.

By providing special cameras for taking images of the vehicles, these cameras may be more freely located than what is possible with the cameras for the follow-process. Thus, it is possible to arrange the cameras such that views from the side or towards the side, obliquely from above, are obtained. In this way, it would be possible also for the number of wheel axles to be registered in the form of an image. In the case of side views, however, there is a risk that the vehicles may conceal one another if multiple lanes are provided. From this point of view, top view are preferable. Also for such views, however, special cameras adjacent to the cameras 9 may be provided.

What is claimed is:

1. A method for determining a toll fee of a vehicle in a road toll unit, comprising:

registering an identification characteristic on a fixed position of the vehicle by means of image processing of video recordings of the vehicle;

determining in the road toll unit whether a toll fee can be paid by means of remote communication between a receiver and transmitter device provided in the road toll unit and a device provided in the vehicle when there is a free flow of traffic, wherein said determining step is determined by receiving signals from said vehicle device;

successively tracking the outer characteristics of the vehicle by said image processing means as the vehicle passes an entry position of the road toll unit and at least until the identification characteristic is registered;

connecting a marker and a time to the recorded image of the outer characteristics of the vehicle and connecting the marker to the recording of the identification characteristic of the vehicle;

correlating at least one image of the outer characteristics of the vehicle to the recording of the identification characteristic, such that the tracking of the vehicle is based on the recording of the identification characteristic and the associated image of the outer characteristics of the vehicle which are matched by means of the marker;

determining the class of the vehicle and the toll fee, in accordance with a vehicle outer characteristics classification scheme, from the image of the outer characteristics of the vehicle;

checking that the toll fee found in the step of determining the class of the vehicle corresponds with the toll fee found in the step of determining in the road toll unit whether a toll fee can be paid; and if incorrect payment of the toll fee has been established in the checking step or no remote communication occurs, subsequently charging the vehicle a toll fee on the basis of the correlated identification characteristic and outer characteristics of the vehicle.

2. A method for determining a toll fee of a vehicle in a road toll unit as recited in claim 1, wherein the image of the vehicle is determined by at least one of the recorded images, the at least one recorded image being provided with the marker and being assigned to the identification characteristic of the vehicle.

3. A method for determining a toll fee of a vehicle in a road toll unit as recited in claim 2, further comprising:

providing classification data for the vehicle by the remote communication from the vehicle device to the receiver and transmitter device provided in the road toll unit;

analyzing the image of the vehicle by image processing the outer characteristics of the vehicle in such a way that data is generated comparable with the data in the classification scheme;

comparing the generated data with the classification data remotely communicated between the vehicle device and road toll unit receiver and transmitter device; and correcting the toll fee if the generated data does not correspond to the classification data.

4. A method for determining a toll fee of a vehicle in a road toll unit as recited in claim 3, further comprising:

sensing the number of wheel axles of the vehicle with sensors placed in a roadway;

connecting sensor impulses of the sensors to the instantaneous position of the vehicle as determined by the successively tracking step, such that markings for the position of the wheel axles are introduced into the image of the vehicle; and registering the number of wheel axles of the vehicle for use in the classification of the vehicle.

5. A method for determining a toll fee of a vehicle in a road toll unit as recited in claim 2, further comprising:

sensing the number of wheel axles of the vehicle with sensors placed in a roadway;

connecting sensor impulses of the sensors to the instantaneous position of the vehicle as determined by the successively tracking step, such that markings for the position of the wheel axles are introduced into the image of the vehicle; and registering the number of wheel axles of the vehicle for use in the classification of the vehicle.

6. A method for determining a toll fee of a vehicle in a road toll unit as recited in claim 1, further comprising:

providing classification data for the vehicle by the remote communication from the vehicle device to the receiver and transmitter device provided in the road toll unit;

analyzing the image of the vehicle by image processing the outer characteristics of the vehicle in such a way that data is generated comparable with the data in the classification scheme;

comparing the generated data with the classification data remotely communicated between the vehicle device and road toll unit receiver and transmitter device; and correcting the toll fee if the generated data does not correspond to the classification data.

7. A method for determining a toll fee of a vehicle in a road toll unit as recited in claim 6, further comprising:

sensing the number of wheel axles of the vehicle with sensors placed in a roadway;

connecting sensor impulses of the sensors to the instantaneous position of the vehicle as determined by the successively tracking step, such that markings for the position of the wheel axles are introduced into the image of the vehicle; and registering the number of wheel axles of the vehicle for use in the classification of the vehicle.

8. A method for determining a toll fee of a vehicle in a road toll unit as recited in claim 1, further comprising:

sensing the number of wheel axles of the vehicle with sensors placed in a roadway;

connecting sensor impulses of the sensors to the instantaneous position of the vehicle as determined by the successively tracking step, such that markings for the position of the wheel axles are introduced into the image of the vehicle; and registering the number of wheel axles of the vehicle for use in the classification of the vehicle.

9. A system for determining a toll fee of a vehicle in a road toll unit in a roadway, comprising:

video cameras for registering an identification characteristic of the vehicle and successively tracking the outer characteristics of the vehicle by means of image processing of video recordings of the vehicle as the vehicle passes an entry position of the road toll unit and at least until the identification characteristic is registered;

a receiver and transmitter device provided in the road toll unit and a device provided in the vehicle, the receiver and transmitter device communicating with the vehicle device and determining whether a toll fee can be paid when there is a free flow of traffic by receiving signals from the vehicle device; and image processing equipment for connecting a marker and a time to the recorded image of the outer characteristics of the vehicle, the image processing equipment connecting the marker to the recording of the identification characteristic of the vehicle, the image processing equipment correlating at least one image of the outer characteristics of the vehicle to the recording of the identification characteristic, such that the tracking of the vehicle is based on the recording of the identification characteristic and the associated image of the outer characteristics of the vehicle which are matched by means of the marker, the image processing equipment determining the class of the vehicle and the toll fee, in accordance with a vehicle outer characteristics classification scheme, from the image of the outer characteristics of the vehicle, the image processing equipment checking that the toll fee found by determining the class of the vehicle corresponds with the toll fee found by determining in the road toll unit whether a toll fee can be paid, and, if incorrect payment of the toll fee has been established or no remote communication occurs, the image processing equipment subsequently charging the vehicle a toll fee on the basis of the correlated identification characteristic and outer characteristics of the vehicle.

10. A system for determining a toll fee of a vehicle in a road toll unit in a roadway as recited in claim 9, wherein the image of the vehicle is determined by at least one of the images recorded by the video cameras, the at least one recorded image being provided with the marker and being assigned to the identification characteristic of the vehicle.

11. A system for determining a toll fee of a vehicle in a road toll unit in a roadway as recited in claim 10, wherein the vehicle device provides classification data of the vehicle to the receiver and transmitter device provided in the road toll unit, the image processing equipment analyzes the image of the vehicle by image processing the outer characteristics of the vehicle in such a way that data is generated comparable with the data in the classification scheme, the image processing equipment compares the generated data with the classification data communicated by the vehicle device to the receiver and transmitter device in the road toll unit, and the image processing equipment corrects the toll fee if the generated data does not correspond to the classification data.

12. A system for determining a toll fee of a vehicle in a road toll unit in a roadway as recited in claim 11, further comprising:

sensors placed in the roadway for sensing the number of wheel axles of the vehicle, wherein the image processing equipment connects impulses of the sensors to the instantaneous position of the vehicle determined by the successive tracking process, such that markings for the position of the wheel axles are introduced into the image of the vehicle, and the image processing equipment registers the number of wheel axles of the vehicle for use in the classification of the vehicle.

13. A system for determining a toll fee of a vehicle in a road toll unit in a roadway as recited in claim 10, further comprising:

sensors placed in the roadway for sensing the number of wheel axles of the vehicle, wherein the image processing equipment connects impulses of the sensors to the instantaneous position of the vehicle determined by the successive tracking process, such that markings for the position of the wheel axles are introduced into the image of the vehicle, and the image processing equipment registers the number of wheel axles of the vehicle for use in the classification of the vehicle.

14. A system for determining a toll fee of a vehicle in a road toll unit in a roadway as recited in claim 9, wherein the vehicle device provides classification data of the vehicle to the receiver and transmitter device provided in the road toll unit, the image processing equipment analyzes the image of the vehicle by image processing the outer characteristics of the vehicle in such a way that data is generated comparable with the data in the classification scheme, the image processing equipment compares the generated data with the classification data communicated by the vehicle device to the receiver and transmitter device in the road toll unit, and the image processing equipment corrects the toll fee if the generated data does not correspond to the classification data.

15. A system for determining a toll fee of a vehicle in a road toll unit in a roadway as recited in claim 14, further comprising:

sensors placed in the roadway for sensing the number of wheel axles of the vehicle, wherein the image processing equipment connects impulses of the sensors to the instantaneous position of the vehicle determined by the successive tracking process, such that markings for the position of the wheel axles are introduced into the image of the vehicle, and the image processing equipment registers the number of wheel axles of the vehicle for use in the classification of the vehicle.

16. A system for determining a toll fee of a vehicle in a road toll unit in a roadway as recited in claim 9, further comprising:

sensors placed in the roadway for sensing the number of wheel axles of the vehicle, wherein the image processing equipment connects impulses of the sensors to the instantaneous position of the vehicle determined by the successive tracking process, such that markings for the position of the wheel axles are introduced into the image of the vehicle, and the image processing equipment registers the number of wheel axles of the vehicle for use in the classification of the vehicle.

* * * * *